US012516530B2

(12) United States Patent
Qiao et al.

(10) Patent No.: US 12,516,530 B2
(45) Date of Patent: Jan. 6, 2026

(54) SCAFFOLD AND METHODS

(71) Applicant: Werner Co., Itasca, IL (US)

(72) Inventors: James Qiao, Shanghai (CH); Claire Armenoff, Montgomery, IL (US); Jerry Lauricella, Schiller Park, IL (US)

(73) Assignee: Werner Co., Itasca, IL (US)

( * ) Notice: Subject to any disclaimer, the term of this patent is extended or adjusted under 35 U.S.C. 154(b) by 863 days.

(21) Appl. No.: 17/742,351

(22) Filed: May 11, 2022

(65) Prior Publication Data

US 2022/0381046 A1 Dec. 1, 2022

Related U.S. Application Data

(60) Provisional application No. 63/192,983, filed on May 25, 2021.

(51) Int. Cl.
*E04G 1/30* (2006.01)
*E04G 1/14* (2006.01)
(Continued)

(52) U.S. Cl.
CPC ..... *E04G 1/30* (2013.01); *E04G 1/14* (2013.01); *E04G 1/24* (2013.01); *E04G 5/00* (2013.01);
(Continued)

(58) Field of Classification Search
CPC .... E04G 1/30; E04G 1/14; E04G 1/24; E04G 5/00; E04G 7/08; E04G 2001/242; E04G 2001/305
See application file for complete search history.

(56) References Cited

U.S. PATENT DOCUMENTS 2,335,046 A * 11/1943 Droeger ..... E04G 1/152 182/119
4,263,984 A * 4/1981 Masuda ..... E04G 1/20 182/119
(Continued)

FOREIGN PATENT DOCUMENTS

CN 201809959 4/2011
CN 106917497 7/2017
(Continued)

OTHER PUBLICATIONS

CNIPA: Application No. 202210564688.0; First Office Action dated Jun. 29, 2023 with English translation, 21 pages.
(Continued)

*Primary Examiner* — Johnnie A. Shablack
(74) *Attorney, Agent, or Firm* — Fitch, Even, Tabin & Flannery LLP

(57) ABSTRACT

A scaffold having a structure assembly. The scaffold has a frame attached to the assembly. The frame having a deck upon which a user can stand that is disposed inside the rectangle. The deck has a plans table. The plans table has a closed position in which the plans table is flat and can support a weight of a user standing on the plans table, and has an open position in which the plans table is at an angle on which plans, drawings or documents can be placed on the plans table for viewing by a user standing on ground. A scaffold having connectors. A method of using a scaffold. A method for connecting a first scaffold to a second scaffold. A method for making a scaffold with connectors. A method for making a scaffold having a plans table.

20 Claims, 9 Drawing Sheets

(51) Int. Cl.
*E04G 1/24* (2006.01)
*E04G 5/00* (2006.01)
*E04G 7/08* (2006.01)

(52) U.S. Cl.
CPC ..... *E04G 7/08* (2013.01); *E04G 2001/242* (2013.01); *E04G 2001/305* (2013.01)

(56) References Cited

U.S. PATENT DOCUMENTS

| | | | | |
|---|---|---|---|---|
| 5,044,467 | A * | 9/1991 | Heiden | E04G 5/00 52/182 |
| 5,152,368 | A * | 10/1992 | Heiden | E04G 5/00 182/222 |
| 5,704,449 | A * | 1/1998 | Ono | E04G 1/154 182/119 |
| 8,474,576 | B2 * | 7/2013 | Renish | E04G 1/15 206/372 |
| 8,490,747 | B2 * | 7/2013 | Winslow | E04G 5/003 182/119 |
| 9,388,588 | B2 * | 7/2016 | Gealy | E04G 1/28 |
| 2004/0016600 | A1 * | 1/2004 | Austin | E04G 1/32 182/186.6 |
| 2009/0078165 | A1 * | 3/2009 | Tseng | E04G 1/32 108/6 |
| 2018/0171648 | A1 * | 6/2018 | Woodward | E04G 1/15 |
| 2022/0381046 | A1 * | 12/2022 | Qiao | E04G 1/30 |
| 2023/0014482 | A1 * | 1/2023 | Ramalho | E04G 1/30 |

FOREIGN PATENT DOCUMENTS

| | | | |
|---|---|---|---|
| CN | 106996187 | A | 8/2017 |
| CN | 107989353 | A | 5/2018 |
| CN | 208329546 | U | 1/2019 |
| CN | 110528979 | | 12/2019 |
| CN | 211058265 | | 7/2020 |
| CN | 111779258 | | 10/2020 |
| CN | 112282331 | | 1/2021 |
| CN | 113202279 | A | 8/2021 |
| EP | 2589728 | | 5/2013 |
| GB | 653953 | | 5/1951 |

OTHER PUBLICATIONS

CNIPA: Application No. 202210564688.0; Second Office Action dated Jan. 15, 2024 with English translation, 17 pages.
CIPA: Application No. 3,159,449; Office Action dated Aug. 25, 2023, 4 pages.
IP Austraila: Application No. 2022203081; Examinatin Report dated Aug. 1, 2023, 8 pages.
Australian Application No. 2022203081; Examination Report dated Jun. 13, 2024, 6 pages.
Chinese Office Action issued in App. No. CN202210564688, dated May 11, 2024, 18 pages.

* cited by examiner

DETAIL A

DETAIL C

SCAFFOLD AND METHODS

CROSS-REFERENCE TO RELATED APPLICATIONS

This is a nonprovisional of U.S. provisional patent application Ser. No. 63/192,983 filed May 25, 2021, incorporated by reference herein.

FIELD OF THE INVENTION

The present invention is related to a scaffold having a plans table. (As used herein, references to the "present invention" or "invention" relate to exemplary embodiments and not necessarily to every embodiment encompassed by the appended claims.) More specifically, the present invention is related to a scaffold having a plans table, which is part of a deck of the scaffold, that can be raised so plans, drawings or documents can be placed on the plans table for viewing by a user standing on ground.

The present invention is related to a scaffold having a connector to connect to and lock with another scaffold. More specifically, the present invention is related to a scaffold having a connector with a spring arm and a pin arm, which together positioned about a leg of the other scaffold to lock the scaffolds together.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

A scaffold is commonly found at construction sites for a multitude of purposes where a user needs to have access over a distance, where a ladder would typically have to be constantly moved to access the same distance. Furthermore, the user typically needs to review plans, drawings or documents to know precisely what work needs to be done. Instead of having to randomly or haphazardly find a location to review plans, drawings or documents, the user would find it very helpful and more efficient to be able to easily review plans, drawings or documents, on a portion of the scaffold specifically made for the review of plants, drawings or documents.

In addition, or separately, the access over a distance may require two or more scaffolds to effectively perform the required task, instead of having to move a single scaffold, or simply placing two scaffolds next to each other. To maximize safety for the user crossing between one scaffold and the next while on the scaffolds, it would be better for the adjoined scaffolds to be locked together to minimize or eliminate movement between the scaffolds.

BRIEF SUMMARY OF THE INVENTION

The present invention pertains to a scaffold. The scaffold comprises a structure assembly having a first vertical leg at a first corner of the assembly, a second vertical leg at a second corner of the assembly, a third vertical leg at a third corner of the assembly and a fourth vertical leg at a fourth corner of the assembly. The first and second vertical legs have a first set of horizontal crossbars between them and the third and fourth vertical legs have a second set of horizontal crossbars between them. The first, second, third and fourth corners defining a rectangle. The scaffold comprises a frame attached to the assembly. The frame having a deck upon which a user can stand that is disposed inside the rectangle. The deck has a plans table. The plans table has a closed position in which the plans table is flat and can support a weight of a user standing on the plans table, and has an open position in which the plans table is at an angle on which plans, drawings or documents can be placed on the plans table for viewing by a user standing on ground.

The present invention pertains to a scaffold. The scaffold comprises a structure assembly having a first vertical leg at a first corner of the assembly, a second vertical leg at a second corner of the assembly, a third vertical leg at a third corner of the assembly and a fourth vertical leg at a fourth corner of the assembly. The first and second vertical legs have a first set of horizontal crossbars between them and the third and fourth vertical legs have a second set of horizontal crossbars between them. The first, second, third and fourth corners defining a rectangle the scaffold comprises a frame attached to the assembly. The frame having a deck that is disposed inside the rectangle upon which a user can stand. The scaffold comprises a first connector attached to the first vertical leg which is adapted to connect to a first leg of a second scaffold. The scaffold comprises a second connector attached to the third vertical leg which is adapted to connect to a third leg of the second scaffold to lock the second scaffold to the first scaffold.

The present invention pertains to a method of using a scaffold. The method comprises the steps of placing a plans table of a deck of a frame in an open position in which the plans table is at an angle on which plans, drawings or documents can be placed on the plans table for viewing by a user standing on ground. The frame attached to a structure assembly. The structure assembly having a first vertical leg at a first corner of the assembly, a second vertical leg at a second corner of the assembly, a third vertical leg at a third corner of the assembly and a fourth vertical leg at a fourth corner of the assembly. The first and second vertical legs have a first set of horizontal crossbars between them and the third and fourth vertical legs have a second set of horizontal crossbars between them. The first, second, third and fourth corners defining a rectangle. There is the step of placing plans, drawings or documents onto the plans table.

The present invention pertains to a method for connecting a first scaffold to a second scaffold. The method comprises the steps of connecting a first connector attached to a first vertical leg of a structure assembly of the first scaffold to a first vertical leg of the second scaffold by positioning a spring arm and a pin arm of the first connector about the first vertical leg of the second scaffold. The structure assembly having the first vertical leg at a first corner of the assembly, a second vertical leg at a second corner of the assembly, a third vertical leg at a third corner of the assembly and a fourth vertical leg at a fourth corner of the assembly. The first and second vertical legs have a first set of horizontal crossbars between them and the third and fourth vertical legs have a second set of horizontal crossbars between them. The first, second, third and fourth corners defining a rectangle. The first scaffold having a frame attached to the assembly. The frame having a deck that is disposed inside the rectangle upon which a user can stand. There is the step of connecting a second connector attached to the third vertical leg to a third vertical leg of the second scaffold by positioning a spring arm and a pin arm of the second connector about the third vertical leg of the second scaffold to lock the second scaffold to the first scaffold.

The present invention pertains to a method for making a scaffold. The method comprises the steps of attaching a first connector to a first vertical leg of a structure assembly. The first connector having a spring arm and a pin arm. The structure assembly having the first vertical leg at a first corner of the assembly, a second vertical leg at a second corner of the assembly, a third vertical leg at a third corner of the assembly and a fourth vertical leg at a fourth corner of the assembly. The first and second vertical legs have a first set of horizontal crossbars between them and the third and fourth vertical legs have a second set of horizontal crossbars between them. The first, second, third and fourth corners defining a rectangle. The first scaffold having a frame attached to the assembly. The frame having a deck that is disposed inside the rectangle upon which a user can stand. There is the step of attaching a second connector to the third vertical leg, the second connector having a spring arm and a pin arm.

The present invention pertains to a method for making a scaffold. The method comprises the steps of attaching a bracket to an underside of a plans table of a deck of a frame. There is the step of attaching a hinge of the frame to the plans table so the plans table can be lifted and maintained in an open position in which the plans table is at an angle on which plans, drawings or documents can be placed on the plans table for viewing by a user standing on ground by the bracket. The frame attached to a structure assembly having a first vertical leg at a first corner of the assembly, a second vertical leg at a second corner of the assembly, a third vertical leg at a third corner of the assembly and a fourth vertical leg at a fourth corner of the assembly. The first and second vertical legs have a first set of horizontal crossbars between them and the third and fourth vertical upgrades have a second set of horizontal crossbars between them. The first, second, third and fourth corners defining a rectangle. The deck is disposed inside the rectangle upon which a user can stand.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 2:
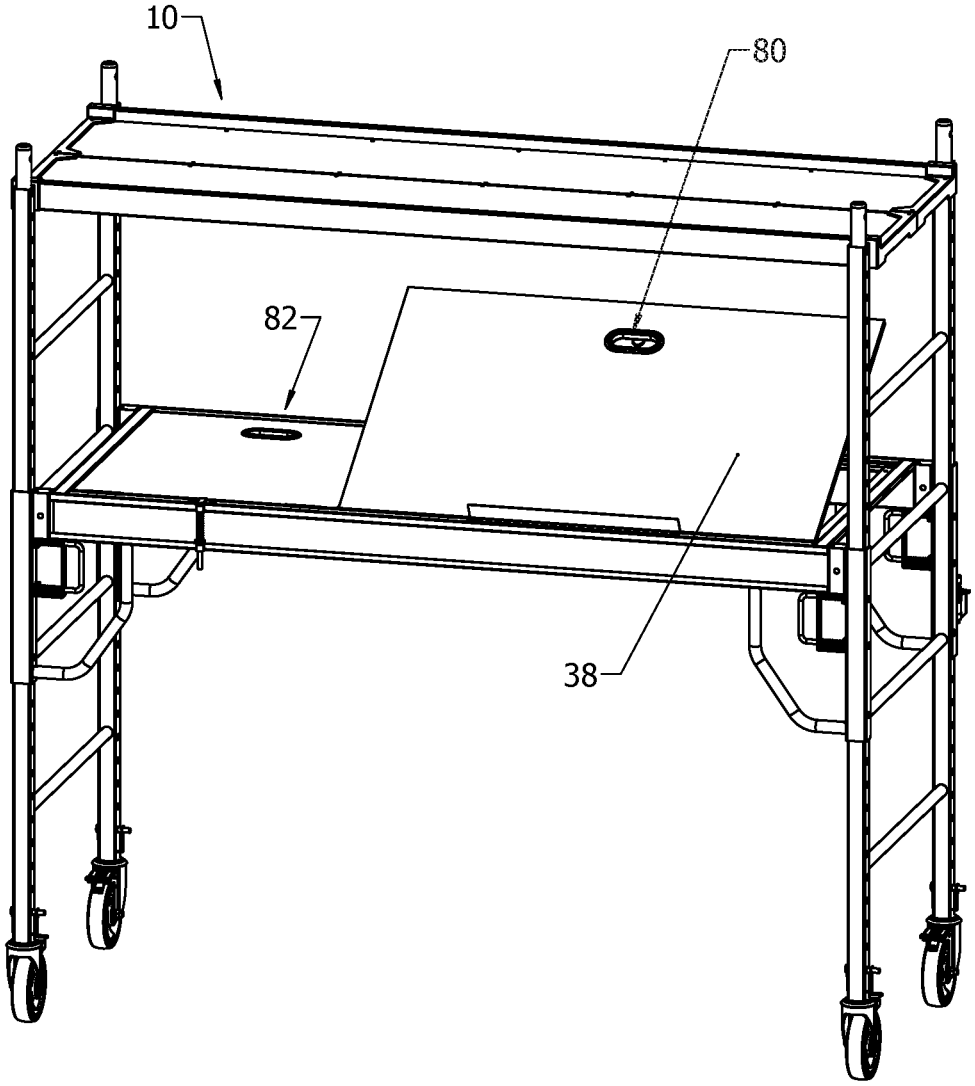
FIGS. 2 and 3 show the plans table in the open position.
Figure 3:
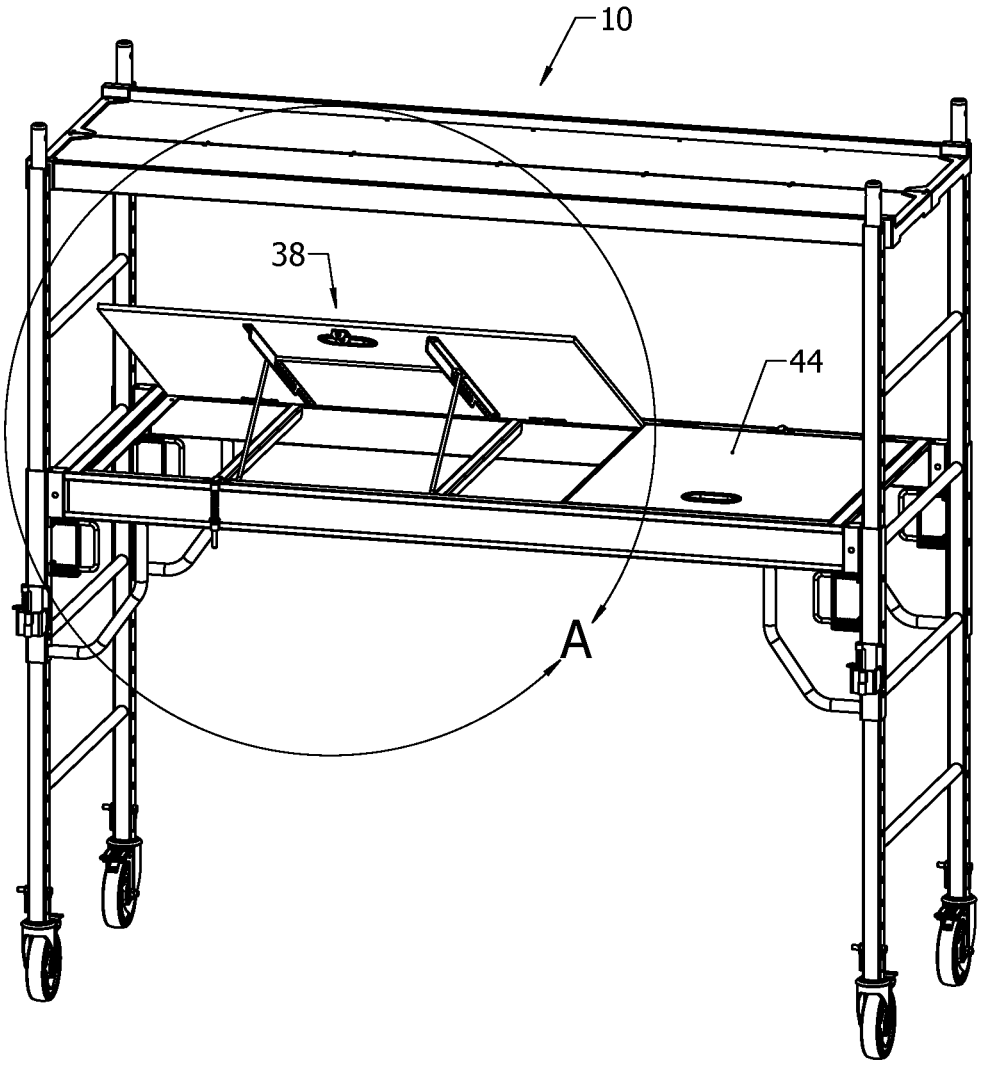
Figure 4:
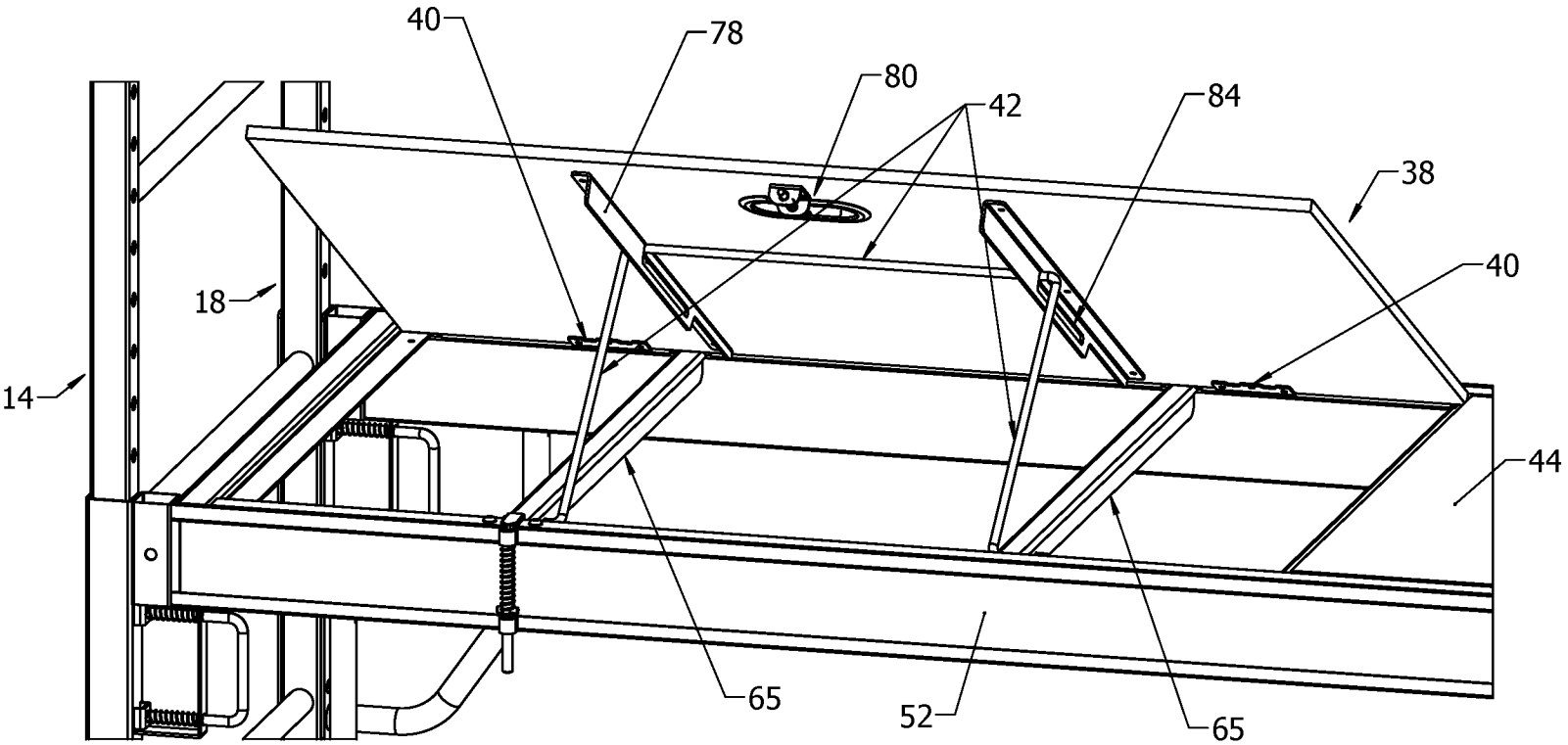
FIG. 4 is a detailed view showing the underside of the open plans table.
Figure 5:
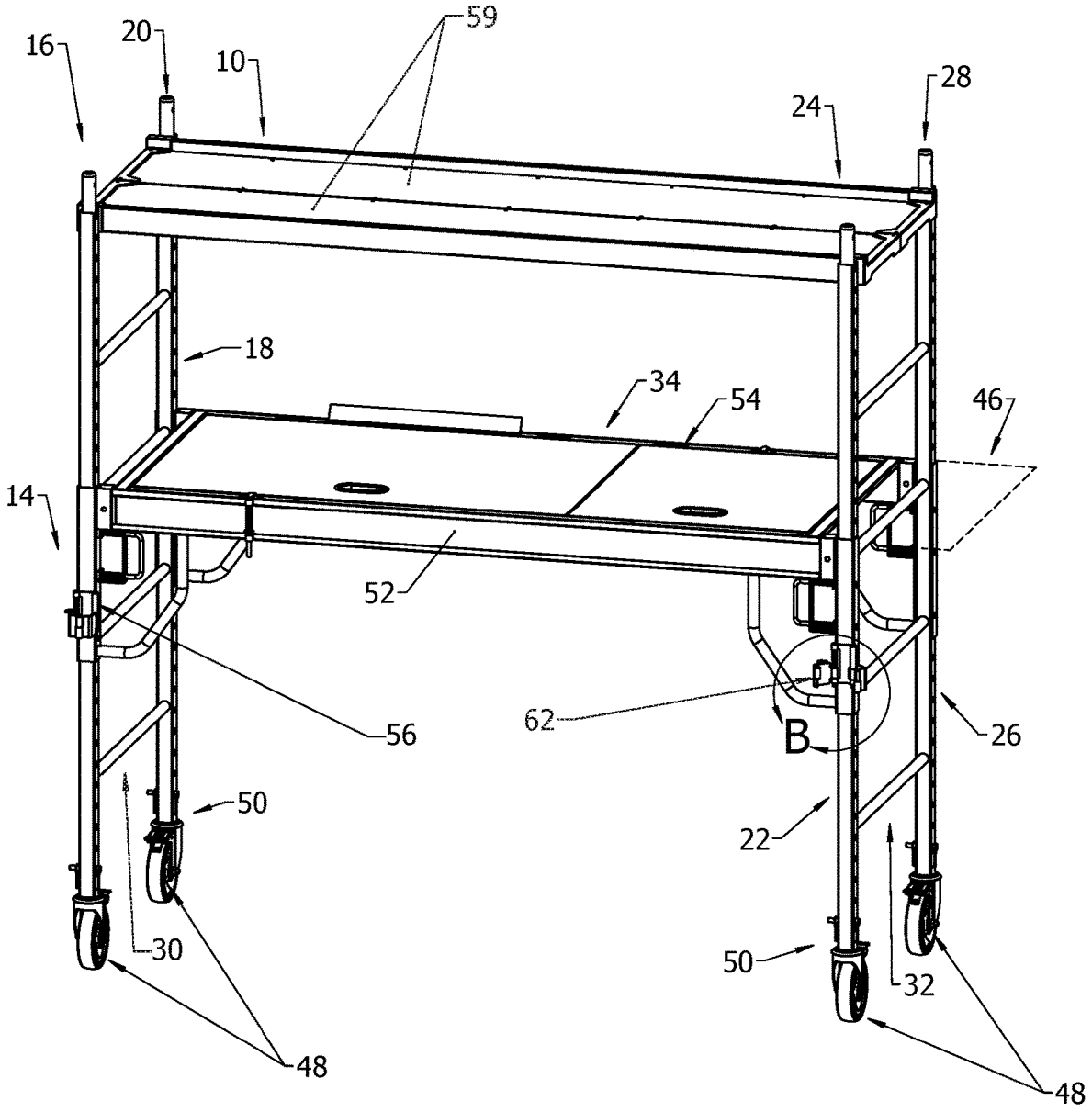
FIG. 5 shows two connectors attached to two legs of the scaffold.

Referring now to the drawings wherein like reference numerals refer to similar or identical parts throughout the several views, and more specifically to FIGS. 4 and 5 thereof, there is shown a scaffold 10. The scaffold 10 comprises a structure assembly 12 having a first vertical leg 14 at a first corner 16 of the assembly 12, a second vertical leg 18 at a second corner 20 of the assembly 12, a third vertical leg 22 at a third corner 24 of the assembly 12 and a fourth vertical leg 26 at a fourth corner 28 of the assembly 12. The first and second vertical legs 14, 18 have a first set of horizontal crossbars 30 between them, and the third and fourth vertical legs 22, 26 have a second set of horizontal crossbars 32 between them. The first, second, third and fourth corners 16, 20, 24, 28 defining a rectangle. The scaffold 10 comprises a frame 34 attached to the assembly 12. The frame 34 having a deck 36 upon which a user can stand that is disposed inside the rectangle. The deck 36 has a plans table 38. The plans table 38 has a closed position in which the plans table 38 is flat and can support a weight of a user standing on the plans table 38, and has an open position, as shown in FIGS. 2, 3 and 4, in which the plans table 38 is at an angle on which plans, drawings or documents can be placed on the plans table 38 for viewing by a user standing on ground. A standard, prior art scaffold is described in U.S. Pat. No. 9,551,160, incorporated by reference herein. The scaffold 10 may support at least 300 pounds of load, and even as much as 500 pounds of load.

The plans table 38 may be connected to the frame 34 by a hinge 40. The plans table 38 may be maintained in the open position by a brace 42, as shown in FIGS. 2, 3 and 4. The deck 36 may have a door 44 that has an open position in which the door 44 is at an angle and the user can climb onto the deck 36 through the door 44 in the open position, and that has a closed position in which the door 44 is flat and forms a plane 46 with the plans table 38 in the closed position and can support the weight of a user standing on the door 44. The scaffold 10 may include a wheel 48 attached to a bottom 50 of each of the first, second, third and fourth legs of the assembly 12 on which the assembly 12 is capable of rolling, as shown in FIG. 5.

Figure 8:
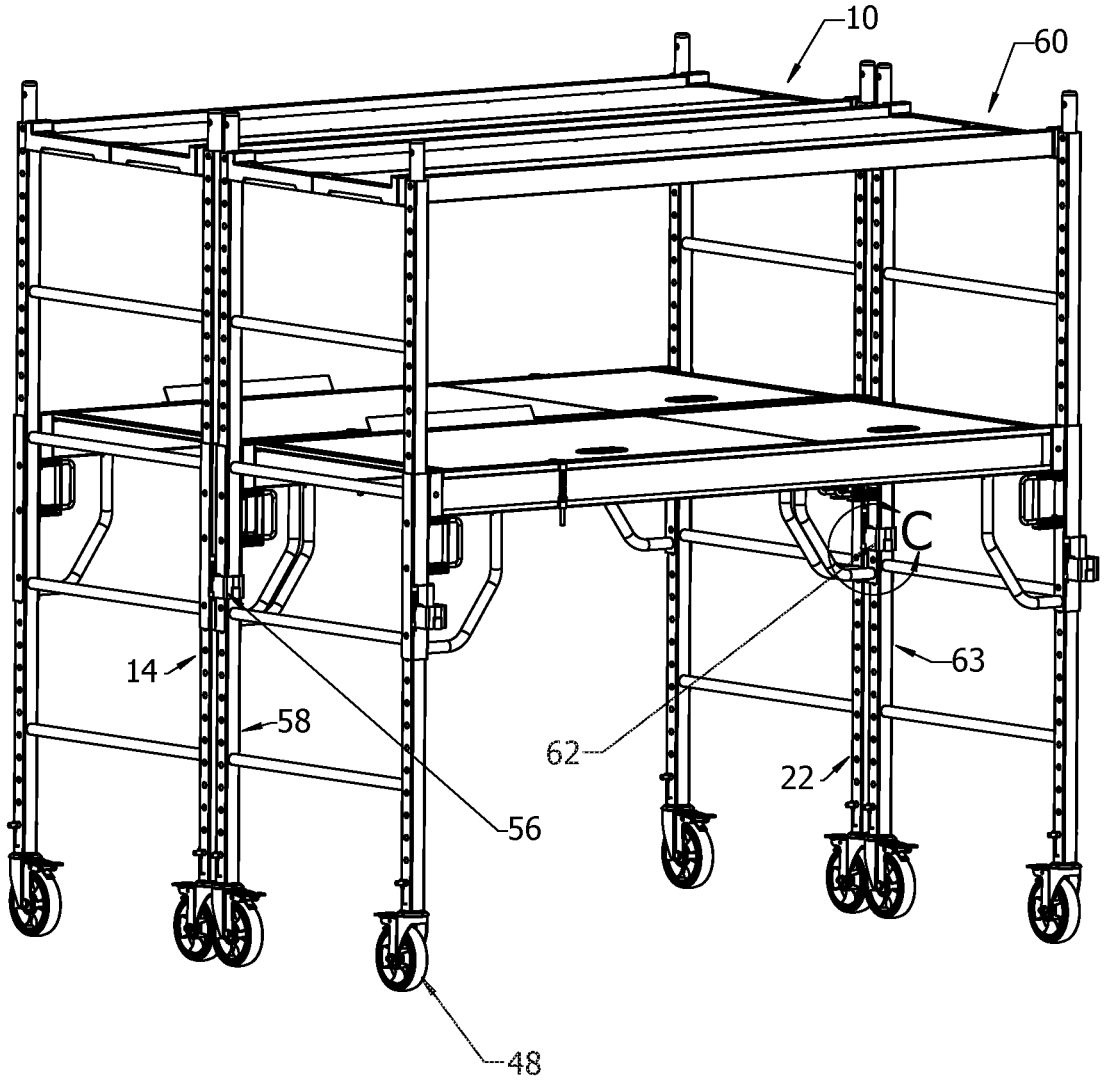
FIG. 8 shows how the connectors are used to link two scaffolds securely together when they are placed side by side.

The frame 34 may have a first elongate member 52 extending between and attached to the first vertical leg 14 and the third vertical leg 22, and a second elongate member 54 extending between and attached to the second vertical leg 18 and the fourth vertical leg 26 and in spaced relation and in parallel with the first elongate member 52. The scaffold 10 may include a first connector 56 attached to the first vertical leg 14 which is adapted to connect to a first leg 58 of a second scaffold 60 and a second connector 62 attached to the third vertical leg 22 which is adapted to connect to a third leg 63 of the second scaffold 60 to lock the second scaffold 60 to the first scaffold 10, as shown in FIG. 8.

The present invention pertains to a first scaffold 10, as shown in FIGS. 5-8. The first scaffold 10 comprises a structure assembly 12 having a first vertical leg 14 at a first corner 16 of the assembly 12, a second vertical leg 18 at a second corner 20 of the assembly 12, a third vertical leg 22 at a third corner 24 of the assembly 12 and a fourth vertical leg 26 at a fourth corner 28 of the assembly 12. The first and second vertical legs 14, 18 have a first set of horizontal crossbars 30 between them and the third and fourth vertical legs 22, 26 have a second set of horizontal crossbars 32 between them. The first, second, third and fourth corners 16, 20, 24, 28 defining a rectangle. The scaffold 10 comprises a frame 34 attached to the assembly 12. The frame 34 having a deck 36 that is disposed inside the rectangle upon which a user can stand. The scaffold 10 comprises a first connector 56 attached to the first vertical leg 14 which is adapted to connect to a first leg 58 of a second scaffold 60. The first scaffold 10 comprises a second connector 62 attached to the third vertical leg 22 which is adapted to connect to a third leg 63 of the second scaffold 60 to lock the second scaffold 60 to the first scaffold 10.

The first connector 56 may have a spring arm 64 with a spring 66 and a pin arm 68 connected to a base 70 by pivot pins 72 which allow these arms to swing, as shown in FIGS. 7A-7D. The first connector 56 may have a pin socket 74 formed in the spring arm 64 and a lock pin 76 fixed to the pin arm 68. In addition to swinging, the spring arm 64 is able to slide up and down its pivot pin. The force of the spring 66 moves the spring arm 64 to its lowest position. The deck 36 may have a plans table 38, as shown in FIGS. 4 and 5. The plans table 38 has a closed position, as shown in FIG. 5, in which the plans table 38 is flat and can support a weight of a user standing on the plans table 38, and has an open position, as shown in FIG. 4, in which the plans table 38 is at an angle on which plans, drawings or documents can be placed on the plans table 38 for viewing by a user standing on ground.

The present invention pertains to a method of using a scaffold 10. The method comprises the steps of placing a plans table 38 of a deck 36 of a frame 34 in an open position in which the plans table 38 is at an angle on which plans, drawings or documents can be placed on the plans table 38 for viewing by a user standing on ground. The frame 34 attached to a structure assembly 12. The structure assembly 12 having a first vertical leg 14 at a first corner 16 of the assembly 12, a second vertical leg 18 at a second corner 20 of the assembly 12, a third vertical leg 22 at a third corner 24 of the assembly 12 and a fourth vertical leg 26 at a fourth corner 28 of the assembly 12. The first and second vertical legs 14, 18 have a first set of horizontal crossbars 30 between them and the third and fourth vertical legs 22, 26 have a second set of horizontal crossbars 32 between them. The first, second, third and fourth corners 16, 20, 24, 28 defining a rectangle. There is the step of placing plans, drawings or documents onto the plans table 38.

The present invention pertains to a method for connecting a first scaffold 10 to a second scaffold 60. The method comprises the steps of connecting a first connector 56 attached to a first vertical leg 14 of a structure assembly 12 of the first scaffold 10 to a first vertical leg 58 of the second scaffold 60 by positioning a spring arm 64 and a pin arm 68 of the first connector 56 about the first vertical leg 58 of the second scaffold 60. The structure assembly 12 having the first vertical leg 14 at a first corner 16 of the assembly 12, a second vertical leg 18 at a second corner 20 of the assembly 12, a third vertical leg 22 at a third corner 24 of the assembly 12 and a fourth vertical leg 26 at a fourth corner 28 of the assembly 12. The first and second vertical legs 14, 18 have a first set of horizontal crossbars 30 between them and the third and fourth vertical legs 22, 26 have a second set of horizontal crossbars 32 between them. The first, second, third and fourth corners 16, 20, 24, 28 defining a rectangle. The first scaffold 10 having a frame 34 attached to the assembly 12. The frame 34 having a deck 36 that is disposed inside the rectangle upon which a user can stand. There is the step of connecting a second connector 62 attached to the third vertical leg 22 to a third vertical leg 63 of the second scaffold 60 by positioning a spring arm 64 and a pin arm 68 of the second connector 62 about the third vertical leg 63 of the second scaffold 60 to lock the second scaffold 60 to the first scaffold 10.

The present invention pertains to a method for making a scaffold 10. The method comprises the steps of attaching a first connector 56 to a first vertical leg 14 of a structure assembly 12. The first connector 56 having a spring arm 64 and a pin arm 68. The structure assembly 12 having the first vertical leg 14 at a first corner 16 of the assembly 12, a second vertical leg 18 at a second corner 20 of the assembly 12, a third vertical leg 22 at a third corner 24 of the assembly 12 and a fourth vertical leg 26 at a fourth corner 28 of the assembly 12. The first and second vertical legs 14, 18 have a first set of horizontal crossbars 30 between them and the third and fourth vertical legs 22, 26 have a second set of horizontal crossbars 32 between them. The first, second, third and fourth corners 16, 20, 24, 28 defining a rectangle. The first scaffold having a frame 34 attached to the assembly 12. The frame 34 having a deck 36 that is disposed inside the rectangle upon which a user can stand. There is the step of attaching a second connector 62 to the third vertical leg 22, the second connector 62 having a spring arm 64 and a pin arm 68.

The present invention pertains to a method for making a scaffold 10. The method comprises the steps of attaching a bracket 78 to an underside of a plans table 38 of a deck 36 of a frame 34. There is the step of attaching a hinge 40 of the frame 34 to the plans table 38 so the plans table 38 can be lifted and maintained in an open position in which the plans table 38 is at an angle supported by the brace 42 through the bracket 78 on which plans, drawings or documents can be placed on the plans table 38 for viewing by a user standing on ground. The frame 34 attached to a structure assembly 12 having a first vertical leg 14 at a first corner 16 of the assembly 12, a second vertical leg 18 at a second corner 20 of the assembly 12, a third vertical leg 22 at a third corner 24 of the assembly 12 and a fourth vertical leg 26 at a fourth corner 28 of the assembly 12. The first and second vertical legs 14, 18 have a first set of horizontal crossbars 30 between them and the third and fourth vertical legs 22, 26 have a second set of horizontal crossbars 32 between them. The first, second, third and fourth corners 16, 20, 24, 28 defining a rectangle. The deck 36 is disposed inside the rectangle upon which a user can stand.

This invention is a scaffold 10 that has a plans table 38 that can be folded up from the standing platform surface and either separately or in addition, has a unique linking and latching mechanism which permits two or more scaffolds to be linked together side by side into a stable structure. Linking two or more scaffolds together enables the user to perform work over a larger area without having to move the scaffold 10. The folding plans table 38 enables the user to easily review documents.

Figure 1:
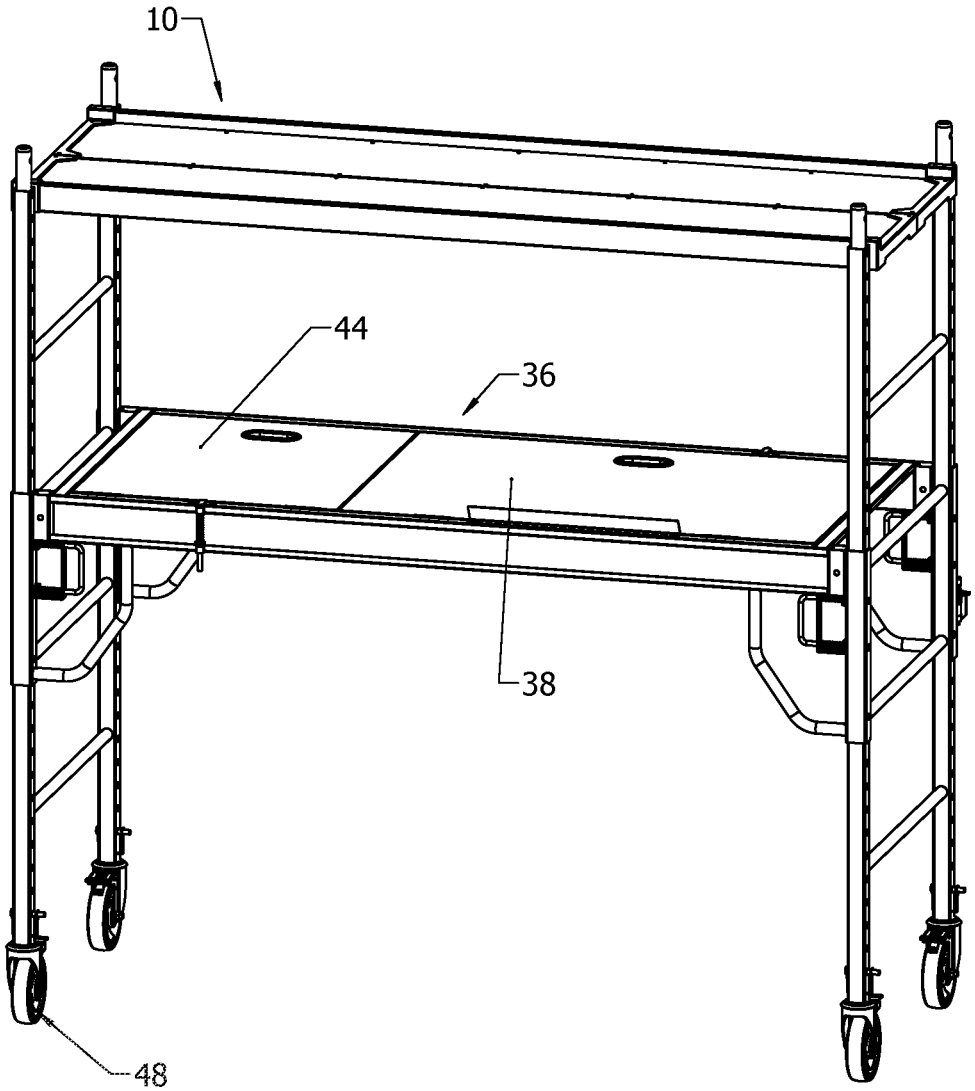
FIG. 1 shows a scaffold on casters.

FIG. 1 shows a scaffold 10 on casters four wheels 48. The deck 36 has a door 44 which is typical for these scaffolds. In addition to the door 44, there is a plans table 38 shown in the closed position. In this position, the plans table 38 can support the weight of a user standing on it. The door 44 has a grip 82 that may be used to lift it. The door 44 is also attached to the first elongate member 52 by a hinge 40. By lifting the door 44, the user can climb up onto the plans table 38 when it is in a closed position, or climb down off the plans table 38.

FIGS. 2 and 3 show the plans table 38 in the open position. In this position plans, drawings, documents can be placed on the plans table 38 for convenient viewing by a user standing on the ground.

FIG. 4 is a detailed view showing the underside of the open plans table 38. The plans table 38 is connected to the scaffold 10 by hinges 40. A U-shaped one-piece metal brace 42 engages slots 84 in brackets 78 to hold the plans table 38 in the open position. The brackets 78 are directly attached to the underside of the plans table 38. The slots 84 extend partially along the length of the brackets 78. The ends of the brace 42 are rotatably attached to the first elongate member 52, for instance with flanges not shown. The brace 42 extends from the first elongate member 52 and through the slots 84 of the brackets 78. When the plans table 38 is lifted by grabbing the handle 80 near the top of the plans table 38, the brackets 78 which are attached to the plans table 38, lift with the plans table 38, causing the brace 42 in the slots 84 to also lift and rotate about the end of the brace 42. The brace 42 in the slots 84, slides up the slots 84 as the plans table 38 is lifted, to the top of the slots 84, where the brace 42 fits into a groove at the top of each slot 84, where the brace 42 is held in place. By being held in place, brace 42 forms an angle relative to the plane 46 and supports the plans table 38 in an upright position for the user to better be able to read and review and write documentation on the plans table 38. Buttresses 65 extend between the first elongate member 52 and the second elongate member 54 to provide additional support to the structure assembly 12 and specifically to the deck 36.

Figure 6:
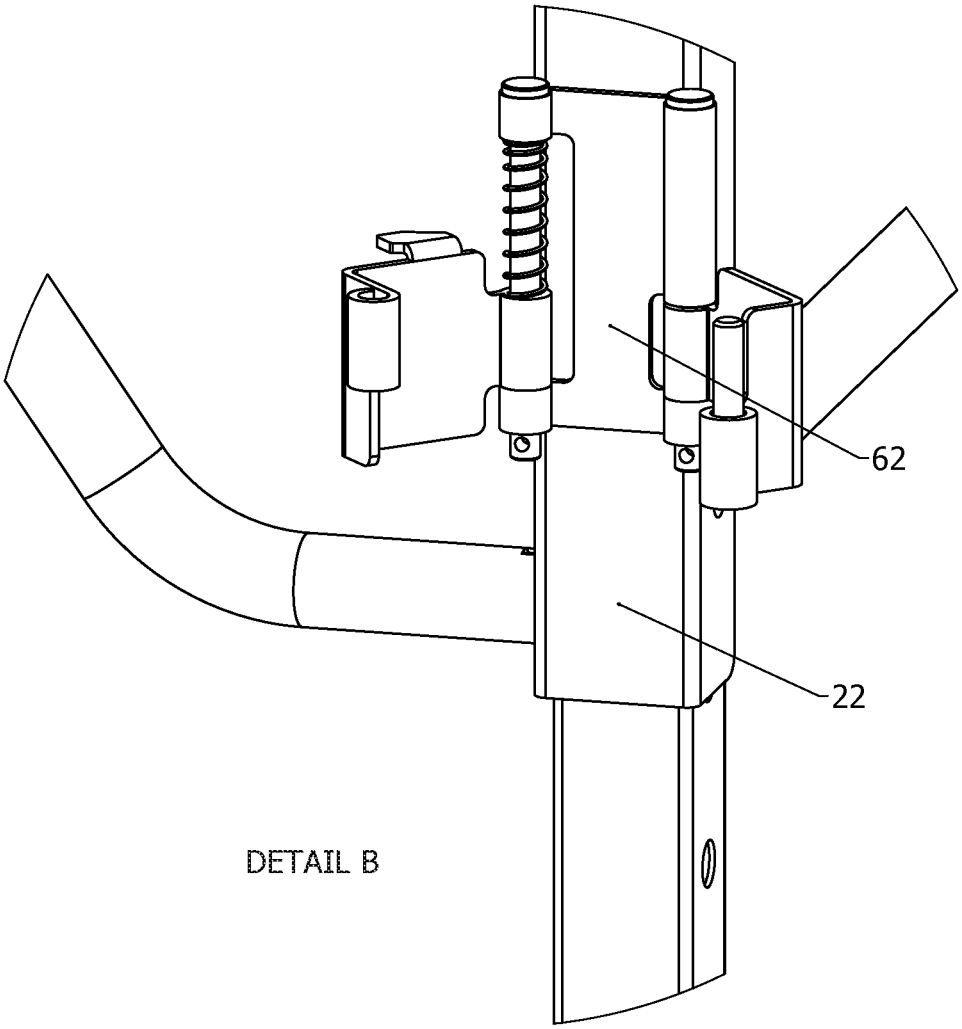
FIG. 6 is a detail view of one of the connectors mounted on one of the scaffold legs.

FIG. 5 shows two connectors 56, 62 attached to two legs 14, 22 of the scaffold 10. FIG. 6 is a detailed view of one of the connectors (62) mounted on one of the scaffold legs (22). Each connector 56, 62 may be mounted to the legs 14, 22, respectively, by the base 70 being braised or welded to the leg to which the base 70 is being mounted so there is a sturdy, stable fixed connection. Removeable planks 59 may be used and supported by opposing cross bars at a desired level. In FIG. 5 two planks 59 are positioned on the top crossbars. When a user stands on the plans table 38, one or both of the planks 59 may be removed so the planks 59 do not interfere with the user.

FIGS. 7A-7D show the components and operation of the connector 56. A spring arm 64 and a pin arm 68 are connected to the base 70 by pivot pins 72 which allow these arms to swing. A pin socket 74 is formed in the spring arm 64. The lock pin 76 is fixed to the pin arm 68. In addition to swinging, the spring arm 64 is able to slide up and down its pivot pin 72. The force of a spring 66 tends to move the spring arm 64 to its lowest position.

Figure 7A:
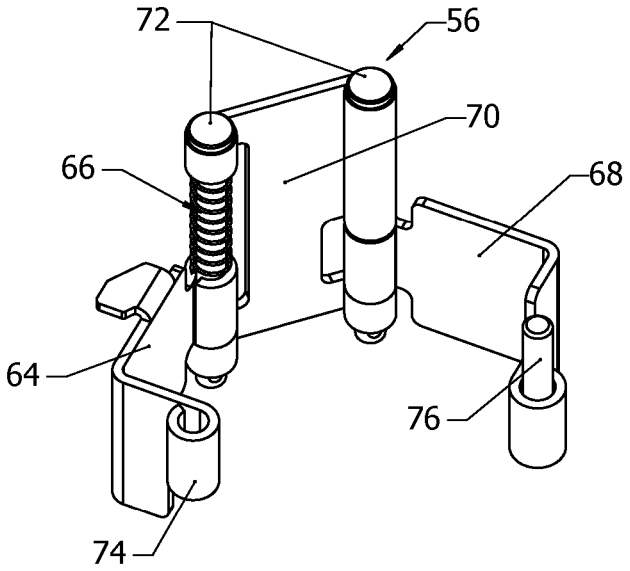
FIGS. 7A-7D show the components and operation of the connector.

FIG. 7A shows the connector 56 in its fully open position.

Figure 7B:
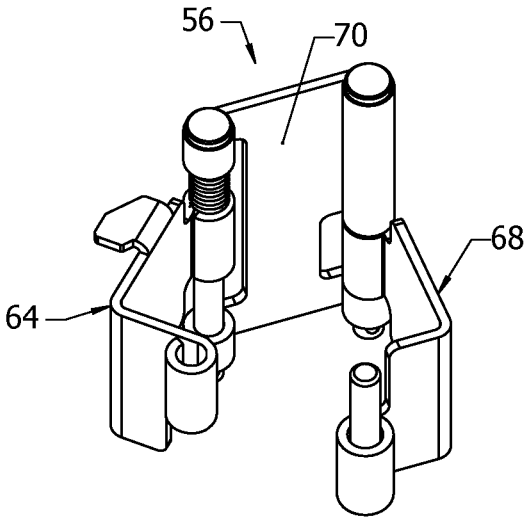
Figure 7C:
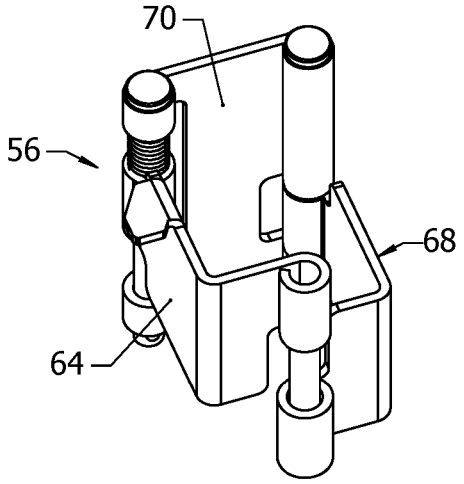

To close the connector 56, FIG. 7B shows that the pin arm 68 has been swung to its closed position, and the spring arm 64 has been moved upward against the spring 66 force. Then the spring arm 64 is swung until its pin socket 74 is aligned with the lock pin 76 on the pin arm 68 as seen in FIG. 7C.

Figure 7D:
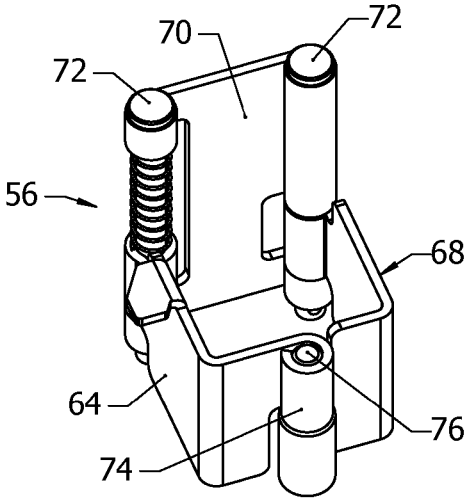

In FIG. 7D, the spring arm 64 has been forced downward by the spring 66 so that the pin socket 74 has completely engaged the lock pin 76. The connector 56 is now closed. The connector 56 can only be opened by deliberately lifting the spring arm 64 against the spring 66 force. The connector 62 operates the same way as the connector 56.

FIG. 8 shows how the connectors 56, 62 are used to link two scaffolds 10, 60 securely together when they are placed side by side.

Figure 9:
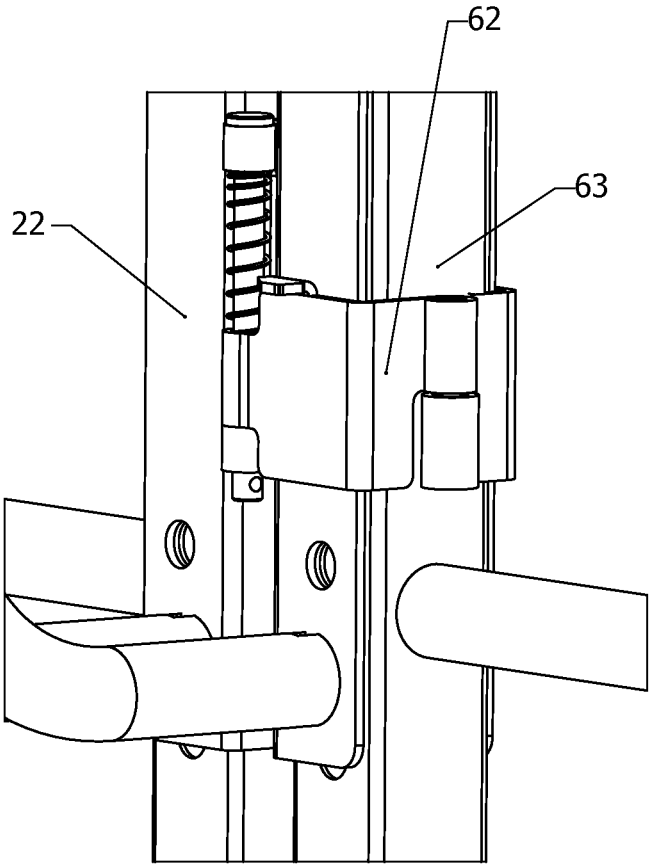
FIG. 9 is a detailed view showing how a connector attached to the leg of the first scaffold locks around the leg of the second scaffold.

FIG. 9 is a detailed view showing how a connector 62 attached to the leg 22 of the first scaffold locks around the leg 63 of the second scaffold 60.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A scaffold comprising:

a structure assembly having a first vertical leg at a first corner of the structure assembly, a second vertical leg at a second corner of the structure assembly, a third vertical leg at a third corner of the structure assembly and a fourth vertical leg at a fourth corner of the structure assembly; the first and second vertical legs having at least one horizontal crossbar between them and the third and fourth vertical legs having at least one horizontal crossbar between them, the first, second, third and fourth corners defining an area; and a frame attached to the structure assembly, the frame having a deck disposed at least partially inside the area, the deck including a plans table, the plans table having a closed position in which the plans table is in line with a remainder of the deck and can support a weight of a user standing on the plans table, and having an open position in which the plans table is at an angle with respect to the remainder of the deck such that plans, drawings or documents can be placed on the plans table at an angle for viewing by a user standing on ground; and the deck further comprising a door that has a first position in which the door is at an angle relative to the remainder of the deck and the user can climb onto the deck through the door in the first position, and that has a second position in which the door is in line with the remainder of the deck, forms a plane with the plans table when the plans table is in the closed position, and can support the weight of a user standing on the door.

2. The scaffold of claim 1 including a wheel attached to a bottom of each of the first, second, third and fourth vertical legs of the structure assembly on which the structure assembly is capable of rolling.

3. The scaffold of claim 1 wherein the frame has a first elongate member extending between and attached to the first vertical leg and the third vertical leg, and a second elongate member extending between and attached to the second vertical leg and the fourth vertical leg and in spaced relation and in parallel with the first elongate member.

4. The scaffold of claim 1 including a first connector attached to the first vertical leg which is adapted to connect to a first leg of a second scaffold and a second connector attached to the third vertical leg which is adapted to connect to a third leg of the second scaffold to lock the second scaffold to the scaffold including the first connector.

5. The scaffold of claim 1, the plans table including a handle.

6. The scaffold of claim 1 wherein the plans table is connected to the frame by a hinge.

7. The scaffold of claim 6 wherein the plans table is supported in the open position by a brace.

8. A scaffold comprising:

a structure assembly having a first vertical leg at a first corner of the structure assembly, a second vertical leg at a second corner of the structure assembly, a third vertical leg at a third corner of the structure assembly and a fourth vertical leg at a fourth corner of the structure assembly; the first and second vertical legs having at least one horizontal crossbar between them and the third and fourth vertical legs having at least one horizontal crossbar between them, the first, second, third and fourth corners defining an area; and a frame attached to the structure assembly, the frame having a deck that is disposed at least substantially inside the area, the deck having a first portion thereof comprising a movable table, the movable table being movable relative to a remainder of the deck and having a first position in which the movable table is in line with a remainder of the deck and a second position in which the movable table is inclined relative to the remainder of the deck;

the deck further comprising a door, the door movable between an open position in which the door is inclined relative to a remainder of the deck and a closed position in which the door is in line with a remainder of the deck.

9. The scaffold of claim 8 wherein the movable table is connected to the frame by a hinge.

10. The scaffold of claim 8 wherein the movable table is supported in the second position by a brace.

11. The scaffold of claim 8 including a wheel attached to a bottom of each of the first, second, third and fourth legs of the structure assembly on which the structure assembly is capable of rolling.

12. The scaffold of claim 8 wherein the frame has a first elongate member extending between and attached to the first vertical leg and the third vertical leg, and a second elongate member extending between and attached to the second vertical leg and the fourth vertical leg and in spaced relation and in parallel with the first elongate member.

13. The scaffold of claim 8 including a first connector attached to the first vertical leg which is adapted to connect to a first leg of a second scaffold and a second connector attached to the third vertical leg which is adapted to connect to a third leg of the second scaffold to lock the second scaffold to the scaffold including the first connector.

14. A scaffold comprising:

a structure assembly having a first vertical leg at a first corner of the structure assembly, a second vertical leg at a second corner of the structure assembly, a third vertical leg at a third corner of the structure assembly and a fourth vertical leg at a fourth corner of the structure assembly, the first, second, third and fourth corners defining an area; and a frame attached to the structure assembly, the frame including a deck disposed inside the area;

wherein the deck has a first hinged section having a hinged edge and an opposite edge opposite to the hinged edge, the first hinged section having a first configuration where the first hinged section is in line with a remaining portion of the deck and a second configuration where the first hinged section is inclined relative to the remaining portion of the deck, the first hinged section further including a ledge projecting from a top surface of the first hinged section for supporting objects in an inclined position when the first hinged section is in the second configuration.

15. The scaffold of claim 14, wherein the deck has a second hinged section having a hinged edge and an opposite edge opposite to the hinged edge, the second hinged section having a closed position where the second hinged section is in line with a remaining portion of the deck and an open position where the second hinged section is inclined relative to the remaining portion of the deck.

16. The scaffold of claim 14, wherein the first hinged section is supported in the second configuration by a brace.

17. The scaffold of claim 14, wherein in the second configuration the first hinged section supports plans, drawings, or documents at an angle.

18. The scaffold of claim 14, wherein the frame has a first elongate member extending between and attached to the first vertical leg and the third vertical leg, and a second elongate member extending between and attached to the second vertical leg and the fourth vertical leg and in spaced relation and in parallel with the first elongate member.

19. The scaffold of claim 14, including a first connector attached to the first vertical leg which is adapted to connect to a first leg of a second scaffold and a second connector attached to the third vertical leg which is adapted to connect to a third leg of the second scaffold to lock the second scaffold to the scaffold including the first connector.

20. The scaffold of claim 14, the first hinged section including a handle.

* * * * *